US006245728B1

(12) United States Patent
Robbins et al.

(10) Patent No.: US 6,245,728 B1
(45) Date of Patent: Jun. 12, 2001

(54) LOW ODOR, HARD SURFACE CLEANER WITH ENHANCED SOIL REMOVAL

(75) Inventors: Michael H. Robbins, Hilden (DE); Jennifer C. Julian, Castro Valley, CA (US); Suzanne M. Thompson, Oakland, CA (US); Gary L. Robinson, Livermore, CA (US); Clement K. Choy, Alamo, CA (US); Elizabeth A. Gossett, Livermore, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 09/427,175

(22) Filed: Oct. 25, 1999

Related U.S. Application Data

(63) Continuation-in-part of application No. 08/731,653, filed on Oct. 17, 1996, now Pat. No. 5,972,876.

(51) Int. Cl.[7] ..... C11D 1/29; C11D 1/72; C11D 3/30; C11D 3/43

(52) U.S. Cl. ..... 510/238; 510/191; 510/421; 510/422; 510/423; 510/424; 510/426; 510/427; 510/432; 510/434; 510/499; 510/506

(58) Field of Search ..... 510/191, 238, 510/421, 422, 423, 424, 426, 427, 432, 434, 499, 506

(56) References Cited

U.S. PATENT DOCUMENTS

| | | | |
|---|---|---|---|
| H269 | 5/1987 | Malik | 422/37 |
| 4,029,607 | 6/1977 | Murtaugh | 252/545 |
| 4,158,644 | 6/1979 | Hamerel | 252/547 |
| 4,207,215 | 6/1980 | Bolan | 252/542 |
| 4,530,781 | 7/1985 | Gipp | 252/546 |
| 4,595,527 | 6/1986 | Gipp | 252/546 |
| 4,637,899 | 1/1987 | Kennedy, Jr. | 252/542 |
| 4,687,592 | 8/1987 | Collins et al. | 252/99 |
| 4,734,259 | 3/1988 | Frenier | 422/16 |
| 4,749,516 | 6/1988 | Brusky | 252/546 |
| 4,844,744 | 7/1989 | Leiter | 134/40 |
| 5,013,483 | 5/1991 | Frenier | 252/396 |
| 5,062,987 | 11/1991 | Turcotte | 252/156 |
| 5,071,582 | 12/1991 | Conville | 252/81 |
| 5,252,245 | 10/1993 | Garabedian, Jr. | 252/153 |
| 5,266,121 | 11/1993 | Cioletti | 134/3 |
| 5,328,561 | 7/1994 | Letize | 156/666 |
| 5,417,887 | 5/1995 | Skeele | 252/309 |
| 5,437,807 | 8/1995 | Garabedian, Jr. | 252/153 |
| 5,454,984 | 10/1995 | Graubart et al. | 252/547 |
| 5,468,423 | 11/1995 | Garabedian, Jr. | 252/546 |
| 5,476,615 | 12/1995 | Hall | 252/547 |
| 5,585,342 | 12/1996 | Choy et al. | 510/433 |
| 5,814,591 | 9/1998 | Mills et al. | 510/238 |
| 5,854,187 * | 12/1998 | Blum et al. | 510/197 |
| 5,948,741 | 9/1999 | Ochomogo et al. | 510/191 |
| 5,948,742 | 9/1999 | Chang et al. | 510/191 |
| 5,972,876 * | 10/1999 | Robbins et al. | 510/423 |

FOREIGN PATENT DOCUMENTS

| | | | |
|---|---|---|---|
| 2-180999 | 7/1990 | (JP) | C11D/3/33 |

OTHER PUBLICATIONS

FWC (filed Feb. 27, 1997) of previously filed U.S. Pat. application Ser. No. 08/507,543, Jul. 26, 1995, "Antimicrobial Hard Surface Cleaner," Zhou et al.

U.S. Pat. application Ser. No. 08/605,822. Feb. 23, 1996, "Composition and Apparatus for Surface Cleaning," Choy et al.

U.S. Pat. application Ser. No. 08/632,041. Apr. 12, 1996, "Hard Surface Cleaner with Enhanced Soil Removal," Mills et al.

* cited by examiner

*Primary Examiner*—Gregory DelCotto
(74) *Attorney, Agent, or Firm*—Joel J. Hayashida

(57) ABSTRACT

An aqueous hard surface cleaner with improved soil removal is provided and has, as components, the following:

(a) either an anionic, nonionic, amphoteric surfactant, and mixtures thereof with, optionally, a quaternary ammonium surfactant, the total amount of the surfactants being; present in a cleaning effective amount;

(b) at least one water-soluble or dispersible organic solvent having a vapor pressure of at least 0.001 mm Hg at 25° C., present in a solubilizing—or dispersion—effective airmount;

(c) a combination of (i) an incompletely neutralized potassium ethylenediamine—tetraacetate (EDTA) and (ii) a precipitating co-builder as chelating agents present in an amount effective to enhance soil removal in said cleaner; and (d) the remainder, water.

17 Claims, No Drawings

LOW ODOR, HARD SURFACE CLEANER WITH ENHANCED SOIL REMOVAL

RELATED APPLICATION

This is a continuation-in-part of application Ser. No. 08/731,653, filed Oct. 17, 1996 now U.S. Pat. No. 5,972,876.

BACKGROUND OF THE INVENTION

1. Field of the Invention

The invention relates to an improved hard surface cleaner especially effective on bathroom soils, such as soap scum. The inventive hard surface cleaner benefits from a novel combination of builders, namely, a precipitating and a non-precipitating builder.

2. Brief Statement of the Related Art

A number of hard surface cleaners have been specially formulated to target bathroom soils. These include products containing liquid hypochlorite for combating mildew and fungus; products with quaternary ammonium compounds as bacteriostats; and acidic cleaners, such as those containing phosphoric or other strong mineral acids.

These cleaners will typically include buffers, dyes, fragrances, and the like in order to provide performance and/or aesthetic enhancements.

Co-pending and parent application Ser. No. 08/731,653, filed Oct. 17, 1996 now U.S. Pat. No. 5,972,876, of Robbins et al., entitled "Low Odor, Hard Surface Cleaner with Improved Soil Removal," of common assignment, discloses and claims a low odor hard surface cleaner which includes amine oxide, quaternary ammonium compound and tetrapotassium ethylenediaminetetraacetate for enhanced and proficient soil removal. Its disclosure is incorporated herein by reference thereto.

Co-pending application Ser. No. 08/807,187, filed Feb. 2, 1997 now U.S. Pat. No. 6,013,615, of Zhou et al., entitled "Antimicrobial Hard Surface Cleaner," also of common assignment, discloses and claims an antimicrobial hard surface cleaner which includes amine oxide, quaternary ammonium compound and tetrasodium EDTA, in which a critical amine oxide: EDTA ratio results in enhanced non-streaking and non-filming performance. Its disclosure is incorporated herein by reference thereto.

Mills et al., U.S. Pat. No. 5,814,591, further of common assignment, discloses and claims a hard surface cleaner which includes surfactants and tetraammonium EDTA for proficient soap scum and soil removal. Its disclosure is incorporated herein by reference thereto.

However, none of the art discloses, teaches or suggest the use of a less than completely neutralized EDTA (especially where the neutralizing agent is a potassium salt—e.g., KOH—resulting in a $K^+$counterion), combined with a precipitating builder (preferably, another and different potassium salt) as an effective chelating agent which additionally surprisingly enhances the soil removing, especially soap scum-removing, ability of the liquid, one phase cleaners formulated therewith. Additionally, unlike some of the prior chelating agents, the combined non-completely neutralized potassium EDTA has very low to no odor, which is a significant beneficial attribute to the inventive cleaners hereof. Moreover, none of the art discloses, teaches or suggests the unexpected speed at which the inventive cleaners work.

SUMMARY OF THE INVENTION AND OBJECTS

The invention provides an aqueous, hard surface cleaner, said cleaner comprising:

an aqueous hard surface cleaner with improved soil, especially soap scum, removal comprising:

(a) either an anionic, nonionic, amphoteric surfactant, and mixtures thereof with optionally, a quaternary ammonium surfactant, said surfactants being present in a cleaning effective amount;

(b) at least one water-soluble or dispersible organic solvent having a vapor pressure of at least 0.001 mm Hg at 25° C., said at least one organic solvent present in a solubilizing or dispersion—effective amount;

(c) a combination of (i) an incompletely neutralized potassium ethylenediamine–tetraacetate (EDTA) and (ii) a precipitating co-builder as chelating agents present in an amount effective to enhance soil removal in said cleaner; and (d) the remainder, water.

The invention further comprises a method of cleaning soils, especially soap scum from hard surfaces by applying said inventive cleaner to said soap scum, and removing both from said surface.

It is therefore an object of this invention to improve soil, especially soap scum, removal from hard surfaces.

It is another object of this invention to markedly increase the speed in which such soils, especially soap scum, are removed from the hard surface cleaned.

It is also an object of this invention to provide a hard surface cleaner for bathroom soils, which include oily and particulate soils.

It is a further object of this invention to provide a low to no odor hard surface cleaner.

It is a still further object of this invention to provide a hard surface cleaner which has at least comparable performance at lower cost compared to a leading cleaner.

It is also an object of this invention to combine non-precipitating and precipitating builders to provide enhanced cleaning.

DETAILED DESCRIPTION OF THE INVENTION

The invention provides an improved, all purpose cleaner especially adapted for the complete and speedy removal of soap scum and other bathroom soils from a hard surface.

These types of cleaners are intended to clean hard surfaces by application of a metered discrete amount of the cleaner, typically by pump or trigger sprayer onto the surface to be cleaned or onto the workpiece—such as a soft cloth, mop or sponge—and then wiping the surface, thus removing the soil and the cleaner, with or without the need for rinsing with water. In the case of a concentrate, the concentrate is first diluted with water, or water/solvent mixture, then the diluted mixture is applied by workpiece or by simply pouring onto the surface to be cleaned. The typical bathroom surface is a shower stall, both the glass doors, as well as the vertical wall surfaces (typically made of tile, or composite materials). sinks and glass. The cleaner is preferably a single phase, clear, isotropic solution, having a viscosity generally less than about 100 Centipoise ("cps") (unless as a concentrate, in which case, below about 100,000 cps). The cleaner itself has the following ingredients:

(a) an anionic, nonionic or amphoteric surfactant, and mixtures thereof with optionally, a quaternary ammonium surfactant, said surfactants being present in a cleaning—effective amount;

(b) at least one water-soluble or dispersible organic solvent having a vapor pressure of at least 0.001 mm Hg at 25° C., said at least one organic solvent present in a solubilizitig- or dispersion-effective amount;

(c) a combination of (i) an incompletely neutralized potassium ethylenediamine—tetraacetate (EDTA) and (ii) a precipitating co-builder as chelating agents present in an amount effective to enhance soil removal in said cleaner; and (d) the remainder, water.

Additional adjuncts in small amounts such as buffers, finance, dye and the like, can be included to provide desirable attributes of such adjuncts.

In the application, effective amounts are generally those amounts listed as the ranges or levels of ingredients in the descriptions which follow hereto. Unless otherwise stated, amounts listed in percentage ("%'s") are in weight percent (based on 100% active) of the composition.

1. Solvents

The solvent is a water soluble or dispersible organic solvent having a vapor pressure of at least 0.001 mm Hg at 25° C. It is preferably selected from $C_{1-6}$ alkanol, $C_{1-6}$ diols, $C_{1-2}$ alkylene glycol ethers, and mixtures thereof. The alkanol can be selected from methanol, ethanol, n-propanol, isopropanol, butanol, pentanol, hexanol, their various positional isomers, and mixtures of the foregoing. It may also be possible to utilize in addition to, or in place of, said alkanols, the diols such as methylene, ethylene, propylene and butylene glycols, and mixtures thereo.

It is preferred to use an alkylene glycol ether solvent in this invention. The alkylene glycol ether solvents can include ethylene glycol monobutyl ether, ethylene glycol monopropyl ether, propylene glycol n-propyl ether, propylene glycol monobutyl ether, diethylene glycol n-butyl ether, dipropylene glycol methyl ether, and mixtures thereof. Preferred glycol ethers are ethylene glycol monobutyl ether, also known as butoxyethanol, sold as butyl Cellosolve by Union Carbide, and also sold by Dow Chemical Co., 2-(2-butoxyethoxy) ethanol, sold as butyl Carbitol, also by Union Carbide, and propylene glycol n-propyl ether, available from a variety of sources. Another preferred alkylene glycol ether is propylene glycol, t-butyl ether, which is commercially sold as Arcosolve PTB, by Arco Chemical Co. The n-butyl ether of propylene glycol is also preferred. Other suppliers of preferred solvents include Union Carbide. If mixtures of solvents are used, the amounts and ratios of such solvents used are important to determine the optimum cleaning and streak/film performances of the inventive cleaner. It is preferred to limit the total amount of solvent to no more than 50%, more preferably no more than 25%, and most preferably, no more than 15%, of the cleaner. A preferred range is about 1–15%. These amounts of solvents are generally referred to as dispersion-effective or solubilizing effective amounts, since the other components, such as surfactants, are materials which are assisted into solution by the solvents. The solvents are also important as cleaning materials on their own, helping to loosen and solubilize greasy soils for easy removal from the surface cleaned.

2. Surfactants

The surfactant is an anionic, nonionic, amphoteric surfactant, or mixtures thereof. Optionally, a quaternary ammonium surfactant can be added.

a. Anionic, Nonionic and Amphoteric Surfactants

The anionic surfactant is, for example, a linear or branched $C_{6-14}$ alkylbenzene sulfonate, alkane sulfonate, alkyl sulfate, or generally, a sulfated or sulfonated $C_{6-14}$ surfactant. Witconate NAS, for example, is a 1-octanesufonate, from Witco Chemical Company. Pilot L-45, a $C_{11.5}$ alkylbenzene sulfonate (which are referred to as "LAS"), from Pilot Chemical Co., Biosoft S100 and S130 (non-neutralized linear alkylbenzene sulfonic acid, which is referred to as "HLAS") and S40 from Stepan Company; sodium dodecyl sulfate and sodium lauryl sulfate. The use of acidic surfactants having a higher actives level may be desirable due to cost-effectiveness.

The nonionic surfactants are selected from alkoxylated alcohols, alkoxylated phenol ethers, and other surfactants often referred to as semi-polar nonionics, such as the trialkyl amine oxides. The alkoxylated phenol ethers include octyl- and nonylphenol ethers, with varying degrees of alkoxylation, such as 1–10 moles of ethylene oxide per mole of phenol. The alkyl group can vary from $C_{6-16}$, although octyl- and nonyl chain lengths are readily available. Various suitable products available from Rohm and Haas under the trademark Triton, such as Triton N-57, N-101, N-111, X45, X-100, X-102, and from Mazer Chemicals under the trademark Macol, from GAF Corporation under the trademark Igepal, from Texaco Chemical Company under the trademark Surfonic. The alkoxylated alcohols include ethoxylated, and ethoxylated and propoxylated $C_{6-16}$ alcohols, with about 2–10 moles of ethylene oxide, or 1–10 and 1–10 moles of ethylene and propylene oxide per mole of alcohol, respectively. Exemplary surfactants are available from Shell Chemical under the trademarks Neodol and Alfonic; and Huntsman. The semi-polar amine oxides are also preferred, although, for the invention, a mixture of nonionic and amine oxide surfactants can also be used. The amine oxides, referred to as mono4ong chain, di-short chain, trialkyl amine oxides, have the general configuration:

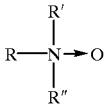

wherein R is $C_{6-24}$ alkyl, and R' and R" are both $C_{1-4}$ alkyl, or $C_{1-4}$ hydroxyalkyl, although R' and R" do not have to be equal. These amine oxides can also be ethoxylated or propoxylated. The preferred amine oxide is lauryl amine oxide. The commercial sources for such amine oxides are Barlox 10, 12, 14 and 16 from Lonza Chemical Company, Varcox by Witco and Ammonyx by Stepan Co.

A further preferred semi-polar nonionic surfactant is alkylamidoalkylenedialkylamine oxide. Its structure is shown below:

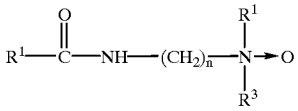

wherein $R^1$ is $C_{5-20}$ alkyl, $R^2$ and $R^3$ are $C_{1-4}$ alkyl,

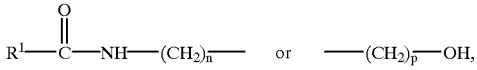

although $R^2$ and $R^3$ do not have to be equal or the same substituent, and n is 1–5, preferably 3, and p is 1–6, preferably 2–3. Additionally, the surfactant could be ethoxylated (1–10 moles of EO/mole) or propoxylated (1–10 moles of PO/mole).

This surfactant is available from various sources, including from Lonza Chemical Company, as a cocoamidopropyldimethyl amine oxide, sold under the brand name Barlox C.

Additionally semi-polar surfactants include phosphine oxides and sulfoxides.

The amphoteric surfactant is typically an alkylbetaine or a sulfobetaine. One group of preferred amphoterics are alkylamidoalkyldialkylbetaines. These have the structure:

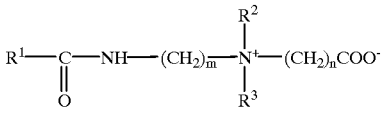

wherein $R^1$ is $C_{6-20}$, alkyl, $R^2$ and $R^3$ are both $C_{1-4}$ alkyl, although $R^2$ and $R^3$ do not have to be equal, and m can be 1–5, preferably 3, and n can be 1–5, preferably 1. These alkylbetaines can also be ethoxylated or propoxylated. The preferred alkylbetaine is a cocoamidopropyldimethyl betaine called Lonzaine CO, available from Lonza Chemical Co. Other vendors are Henkel KGaA, which provides Velvetex AB, and Witco Chemical Co., which offers Rewoteric AMB-15, both of which products are cocobetaines.

The amounts of surfactants present are to be somewhat minimized, for purposes of cost-savings and to generally restrict the dissolved actives which could contribute to leaving behind residues when the cleaner is applied to a surface. However, the amounts added are generally about 0.001–10%, more preferably 0.002–3.00% surfactant. These are generally considered to be cleaning-effective amounts. On the other hand, if a dilutable concentraite is desired, the upper level of surfactant can be as high as 25%, more preferably around 15%. If a mixture of anionic and nonionic or amphoteric surfactants is used, the ratio of the anionic surfactant to the nonionic or amphoteric surfactant is about 20:1 to 1:20, more preferably about 10:1 to 1:10.

b. Quaternary Ammonium Surfactant

The invention may further optionally include a cationic surfactant, specifically, a quaternary ammonium surfactant. These types of surfactants are typically used in bathroom cleaners because they are generally considered "broad spectrum" antimicrobial compounds, having efficacy against both gram positive (e.g., *Staphylococcus sp.*) and gram negative (e.g., *Escherischia coli*) microorganisms. Thus, the quaternary ammonium surfactant, or compounds, are incorporated for bacteriostatic/disinfectant purposes and should be present in amounts effective for such purposes.

The quaternary ammonium compounds are selected from mono-long-chain, tri-short-chain, tetraalyl ammonium compounds, di-long-chain, di-short-chain tetraalkyl ammonium compounds, triallyl, monc-benzyl ammonium compounds, and mixtures thereof. By "long" chain is meant about $C_{6-30}$ alkyl. By "short" chain is meant $C_{1-5}$ alkyl, preferably $C_{1-3}$. Preferred materials include Stepan series, such as BTC 2125 series; Barquat and Bardac series, such as Bardac MB 2050, from Lonza Chemical. Typical amounts of the quaternary ammonium compound range from preferably about 0–5%, more preferably about 0.001–2%.

3. Combination of Chelating Agents (i) Incompletely Neutralized Potassium EDTA

The incompletely neutralized ethylene diamine tetraacetate (referred to as "K to $K_3$ EDTA") is a critical part of the invention. Its use, in place of a standard chelating agent, tetrasodium EDTA, results in not only a surprisingly complete removal of various soils, including bathroom soap scum soils, but an unexpectedly rapid removal as well. The fact that this salt of EDTA is so effective versus the tetrasodium salt was quite unawaited since, in other literature (except for the co-pending Parent application, Ser. No. 08/731,653, filed Oct, 17, 1996 now U.S. Pat. No. 5,972,876; hereinafter, the "Parent") a potassium salt has not been demonstrated to be a superior performer as compared to the tetrasodium salt. Additionally, in comparison to another favorable salt, tetraarmonium EDTA, the inventive potassium EDTA has a distinct advantage in having low or no odor. This latter advantage is quite significant since the user of a cleaning product will not be favorably inclined to repeat usage of a product whose odor may not please her/him. Moreover, in comparison to the Parent, it has been found that there is a significant cost savings and at least comparable, if not better, performance benefits when $K_3$EDTA is used in conjunction with a precipitating co-builder, most preferably either potassium carbonate, $K_2CO_3$, or potassium oxalate, $K_2C_2O_4$.

The K to $K_3$EDTA can favorably be prepared by taking the acid form of EDTA and neutralizing it with KOH in a less than stoichiometric quantity. For example, to 7g of the acid form of EDTA and 79.3g deionized water, 2.1g of KOH solution (45%) can be slowly added, resulting in a 52% $K_3$EDTA solution. The acid form of EDTA can be obtained from Hampshire Chemicals and Aldrich Chemicals. In the neutralization of the acid form of EDTA, it is preferred to use less than a stoichiometric amount of alkali. It is most preferred to use either $K_3$ or $K_2$EDTA, with the non-neutralized sites on the molecule remaining protonated.

The amount of K to $K_3$EDTA added should be in the range of 0.01–30%, more preferably 0.01–20%, by weight of the cleaner.

(ii) Precipitating Co-Builder

The other component of the combined chelating agent is a precipitating co-builder. It is preferred to be a precipitating potassium salt. Most preferred are potassium carbonate, $K_2CO_3$, or potassium oxalate, $K_2C_2O_4$.

It is not exactly understood why, but the combination of the precipitating co-builder with the K to $K_3$EDTA results in a synergistic cleaning performance at least comparable to the use of $K_4$EDTA alone, as the chelating agent, which is the invention claimed in the Parent.

On the other hand, the inventors have additionally discovered that, unlike the Parent, if a combination of $K_4$EDTA and an amount of precipitating co-builder, especially $K_2CO_3$ in an amount greatly exceeding 0.10%, or $K_2C_2O_4$ in an amount not so restricted, is used, there will be a performance benefit exceeding the $K_4$EDTA alone, or with no more than 0.10% $K_2CO_3$. This is an additional embodiment of the invention.

The amount of the combined chelating agents should be about 0.5 to 15% of the K to $K_3$EDTA, and the precipitating co-builder, about 0.1 to 15%, the ratio of the other to the other being about 10:1 to 1:1.

On the other hand, when the combination of $K_4$EDTA and an amount of precipitating co-builder are used, the $K_4$EDTA should be about 0.5 to 15%, and the precipitating co-builder must exceed 0.1, to about 15%, and especially preferably exceeds 1%, the ratio of the first to the other being about 10:1 to 1:1.

4. Water and Miscellaneous

Since the cleaner is an aqueous cleaner with relatively low levels of actives, the principal ingredient is water, which should be present at a level of at least about 50%, more preferably at least about 80%, and most preferably, at least about 90%. Deionized water is preferred.

Small amounts of adjuncts can be added for improving cleaning performance or aesthetic qualities of the cleaner. For example, buffers could be added to maintain constant pH (which for the invention is between about 7–14, more preferably between about 8–13). These buffers include NaOH, KOH, $Na_2CO_3$, $K_2CO_3$, as alkaline buffers, and phosphoric, hydrochloric, sulfuric acids as acidic buffers, and others. KOH is a preferred buffer since, in the invention, one way of obtaining potassium EDTA is to take the acidic EDTA acid and neutralize it with an appropriate, stoichiometric amount of KOH. Builders, such as phosphates, silicates, and again, carbonates, may be desirable. Further solubilizing materials, such as hydrotropes, e.g.s., cumene, toluene and xylene sulfonates, may also be desirable. Adjuncts for cleaning include additional surfactants, such as those described in *Kirk-Othumer Encyclopedia of Chemical Technology*, 3rd Ed., Volume 22, pp. 332–432 (Marcel-Dekker, 1983), and *McCutcheon's Soaps and Detergents* (N. Amer. 1984), which are incorporated herein by reference. Aesthetic adjuncts include fragrances, such as those available from Givaudan, IFF, Quest, Sozio, Bush Boake and Allen, Firmenich, Dragoco and others, and dyes and pigments which can be solubilized or suspended in the formulation, such as diaminoanthraquinones. Water-insoluble solvents may sometimes be desirable as added grease or oily soil cutting agents. These types of solvents include tertiary alcohols, hydrocarbons (alkanes), pine-oil, d-limonene and other terpenes and terpene derivatives, and benzyl alcohols. However, it is less preferred to use propellants, such as in an aerosol formulation, since those usually involve solvents which are stringently regulated (too high VOC's) and will also raise materials costs of these formulations. Thickeners, such as calcium carbonate, sodium bicarbonate, aluminum oxide, and polymers, such as polyacrylate, starch, xanthan gum, alginates, guar gum, cellulose, and the like, may be desired additives. The use of some of these thickeners ($CaCO_3$ or $NaHCO_3$) is to be distinguished from their potential use as builders, generally by particle size or amount used. Further, small particle size solids can be used as abrasives (see co-pending application Ser. No. 09/427,156, filed concurrently herewith, in the names of David Peterson et al., commonly assigned, and entitled "Low Odor, Hard Surface Abrasive Cleaner with Enhanced Soil Removal," incorporated herein by reference). Antifoaming agents, or foam controlling agents, may be also desirable, such as silicone defoamers. The amounts of these cleaning and aesthetic adjuncts should be in the range of 0–10%, more preferably 0–2%.

In the following Experimental section, the surprising performance benefits of the various aspects of the inventive cleaner are demonstrated.

EXPERIMENTAL

In the following Examples, various embodiments of the invention are depicted, and soil removal performances of the inventive cleaners were conducted. Further, in the examples, where footnotes identify components and the components are repeated in further examples, the footnotes are not reiterated.

Artificial soils were prepared in accordance with standards developed by the American Society for Testing and Materials ("ASTM") and modified by Applicants. The bathroom soil was prepared according to ASTM standard No. D5343-93 (incorporated herein by reference). Soap scum soil consisted of a layer of calcium stearate—to which a blue pigment was added as an indicator for soil removal—baked onto a ceramic tile.

In these tests, soil removal is either visually measured, using a panel of experts who view soil removal on a 1 to 10 scale, with 10 being better, or, when using an automated assay, using a proprietary device to determine the cumulative amount of soil removed it each cycle, with a maximum of 10–100 cycles, depending on the test run. The higher score achieved is more preferred.

A first base formulation is depicted below:

TABLE I (Invention Example I)

| Ingredient | Wt. % |
|---|---|
| $K_2CO_3$ | 0.1 |
| $K_3EDTA$ (52%) | 10.1 |
| Butyl Carbitol[1] | 4.5 |
| Quaternary Ammonium Compound[2] (50%) | 0.55 |
| Amine Oxide[3] (30%) | 3.33 |
| Fragrance | 0.2 |
| Deionized Water | q.s. |

[1]Solvent, Union Carbide
[2]Antimicrobial surfactant BTC 2125, Stepan, which can be optional
[3]Surfactant, $C_{12}$ amine oxide, Stepan

TABLE II (Comparison Example II - SN 08/731,653)

| Ingredient | Wt. % |
|---|---|
| $K_2CO_3$ | 0.1 |
| $K_4EDTA$ (48%) | 11.2 |
| Butyl Carbitol[1] | 4.5 |
| Quatemary Ammonium Compound[2] (50%) | 0.55 |
| Amine Oxide[3] (30%) | 3.33 |
| Fragrance | 0.2 |
| Deionized Water | q.s. |

These formulas were then tested on bathroom soils loaded onto white tiles. The tiles were then cleaned with the proprietary device, with four replicates of 15 cycles each. The results are depicted below:

TABLE III (Soap Scum Soil Removal)

| Example | Replicates | Relative Score |
|---|---|---|
| I | 4 | 100 |
| II | 4 | 98 |
| III[1] | 4 | 99 |
| IV[2] | 4 | 3 |

The above examples demonstrate that the inventive formulations I and III had comparable performance to that exhibited by the Parent, U.S. Pat. No. 5,972,876, which is not expected given the different species of chelant used.

In the next set of Examples below, the effect of increasing the precipitating co-builder is explored.

TABLE III (Inventive Formula, Example V)

| Ingredient | Wt. % |
|---|---|
| $K_2CO_3$ | 0.1 |
| $K_3EDTA$ (38.4%) | 12 |
| Butyl Carbitol | 4.5 |
| Quaternary Ammonium | 0.55 |

TABLE III-continued (Inventive Formula, Example V)

| Ingredient | Wt. % |
|---|---|
| Compound[1] (50%) | |
| Amine Oxide (30%) | 3.33 |
| Fragrance | 0.2 |
| Deionized Water | q.s. |

[1]Barquat, from Lonza

Example V has a pH of about 7.7.

TABLE IV (Inventive Formula Variation, Example VI)

| Ingredient | Wt. % |
|---|---|
| $K_2CO_3$ | 3 |
| $K_3EDTA$ (52%) | 7 |
| Butyl Carbitol | 4.5 |
| Quaternary Ammonium Compound[1] (50%) | 0.55 |
| Amine Oxide (30%) | 3.33 |
| Fragrance | 0.2 |
| Deionized Water | q.s. |

Example VI has a pH of about 10.1.

Using the soap scum test, Examples V and VI were tested for performance, in which tiles were coated with one coat of soap scum, then a discrete portion of the formulas were dropped onto the tiles and allowed to work for 60, 90 and 120 seconds, respectively, and graded by an expert panel on a 1 to 10 score, with 10 being best, and 1 being no cleaning. The results are tabulated in TABLE V:

TABLE V (Soap Scum Removal)

| Time (seconds) | Example V | Example VI |
|---|---|---|
| 120 | 9 | 8 |
| 90 | 7 | 5 |
| 60 | 6 | 3 |

The results indicate that pH of the Examples may influence results. Thus, a further study was conducted. In this study, additional portions of KOH (neutralizing agent) were added to Examples V and VI, to result in pH's of 12.47 and 12.54, respectively. These were then tested against a commercial formulation which tracks Example II ($K_4EDTA$) above.

TABLE VI (Soap Scum Removal)

| Time (seconds) | Example V | Example VI | Comparison |
|---|---|---|---|
| 120 | 9 | 10 | 9 |
| 90 | 7 | 7 | 7 |
| 60 | 6 | 6 | 5 |

This demonstrates that higher alkalinity can effect the performance of the invention positively.

In the next set of examples demonstrate another embodiment of the invention, namely $K_4EDTA$ combined with a precipitating co-builder, and when the co-builder is $K_2CO_3$, the amount of this latter ingredient must exceed 0.1% and most preferably exceeds about 1.0%. The results are set forth in TABLE VII. The performance studies were using soap scum with one coat on tiles, four replicates.

TABLE VII

| Example | % Amine Oxide[1] | % Ethylene Glycol N-Butyl Ether[2] | % $K_4EDTA$ | % $K_2C_2O_4$ | % $K_2CO_3$ | Relative % Soil Removal[3] |
|---|---|---|---|---|---|---|
| VII (Control) | 1 | 4.5 | 0 | 0 | 0 | 1.07% |
| VIII (Comp.) | 1 | 4.5 | 0 | 0 | 2.95 | 12.79% |
| IX (Comp.) | 1 | 4.5 | 0 | 2.27 | 0 | 27.32% |
| X (Comp.) | 1 | 4.5 | 3.21 | 0 | 0 | 46.50% |
| XI (Inv.) | 1 | 4.5 | 3.21 | 0 | 2.95 | 100% |
| XII (Inv.) | 1 | 4.5 | 3.21 | 2.27 | 0 | 86.69% |
| XIII (Comp.) | 1 | 4.5 | 4.69 | 0 | 0 | 72.5% |

The invention is further defined and delineated by the claims which follow hereto.

What is claimed is:

1. A non-aerosol, aqueous hard surface cleaner with improved soil removal comprising:

(a) form about 0.001 to 25% of an anionic, nonionic, amphoteric surfactant, and mixtures thereof with optionally, a quaternary ammonium surfactant;

(b) from about 0.1% to 50% of at least one water-soluble or dispersible organic solvent having a vapor pressure of at least 0.001 mm Hg at 25° C.;

(c) a combination of (i) from about 0.5% to 15% of an incompletely neutralized potassium ethylenediamine—tetraacetate (EDTA) and (ii) more than 0.1% to 15% of a precipitating potassium co-builder as chelating agents wherein the ratio of incompletely neutralized potassium ethylenediamine tetraacetate to precipitating potassium cobuilder is 10:1 to 1:1; and (d) the remainder, water.

2. The cleaner of claim 1 which comprises a single phase, isotropic solution.

3. The cleaner of claim 1 wherein said surfactant is an anionic surfactant of (a) selection from the group consisting of a linear or branched $C_{6-14}$ alkylbenzene sulfonate, alkane sulfonate, alkyl sulfate, and mixtures thereof.

4. The cleaner of claim 1 wherein said surfactant of (a) is a nonionic surfaetant selection from the group consisting of an alkoxylated alkylphenol ether, an alkoxylated alcohol, or a semi-polar nonionic surfactant.

5. The cleaner of claim 4 wherein said nonionic surfactant is a semi-polar nonionic surfactant selected from the group consisting of mono-long-chain alkyl, di-short-chain trialkyl amine oxides, alkylamidodialkyl amine oxides, phosphine oxides and sulfoxides.

6. The cleaner of claim 5 wherein said nonionic surfactant of (a) is a mono-long-chain, di-short-chain trialkyl amine oxide.

7. The cleaner of claim 4 wherein said nonionic surfactant is an ethoxylated alkylphenol ether selected from the group consisting of ethoxylated octylphenol ethers, ethoxylated nonylphenol ethers, and mixtures thereof.

8. The cleaner of claim 7 wherein said nonionic surfactant is an ethoxylated octylphenol, ethoxylated with 1–10 moles of ethylene oxide.

9. The cleaner of claim 1 wherein said organic solvent of (b) is selected from the group consisting of alkanols, diols, glycol ethers, and mixtures thereof.

10. The cleaner of claim 9 wherein said organic solvent is a $C_{1-24}$ glycol ether.

11. The cleaner of claim 1 further comprising d) a quaternary ammonium compound.

12. The cleaner of claim 11 wherein said quaternary ammonium compound is selected from the group consisting of mono-long-chain, tri-short-chain, tetraalkyl ammonium compounds, di-long-chain, di-short-chain tetra-alkyl ammonium compounds, trialkyl, mono-benzyl ammonium compounds, and mixtures thereof.

13. The cleaner of claim 1 further comprising (e) at least one adjunct selected from the group consisting of builders, buffers, fragrances, thickeners, dyes, abrasives, oxidants, pigments, foaming stabilizers, water-insoluble organic solvents, and hydrotropes.

14. The cleaner of claim 1 wherein said incompletely neutralized EDTA of c)(i) is prepared by neutralizing the acid form of EDTA with a potassium salt.

15. The cleaner of claim 14 wherein the neutralizing agent is potassium hydroxide.

16. The cleaner of claim 15 wherein said potassium hydroxide is present in a less than stoichiometric amount.

17. The cleaner of claim 14 wherein the precipitating builder of c)(ii) is potassium carbonate or potassium oxalate.

* * * * *